US007997545B2

(12) United States Patent
Holland

(10) Patent No.: US 7,997,545 B2
(45) Date of Patent: Aug. 16, 2011

(54) PIVOTING SUPPORT STRUCTURE

(76) Inventor: Rodney W. Holland, Bloomington, MN (US)

( * ) Notice: Subject to any disclaimer, the term of this patent is extended or adjusted under 35 U.S.C. 154(b) by 151 days.

(21) Appl. No.: 12/459,676

(22) Filed: Jul. 7, 2009

(65) Prior Publication Data

US 2011/0006179 A1 Jan. 13, 2011

(51) Int. Cl.
*A47J 47/16* (2006.01)

(52) U.S. Cl. ..... 248/145; 248/131; 248/144; 232/39

(58) Field of Classification Search ..... 248/144, 248/145, 130, 131; 232/39; 16/76, 284, 16/285, 304, 303
See application file for complete search history.

(56) References Cited

U.S. PATENT DOCUMENTS 1,273,696 A * 7/1918 Vanhoof ..... 248/145
1,508,052 A * 9/1924 Hastings ..... 248/145
5,437,409 A * 8/1995 Coushaine ..... 232/39
5,560,583 A * 10/1996 Holmgren ..... 248/652
7,481,357 B1 * 1/2009 Totis ..... 232/39
* cited by examiner

*Primary Examiner* — Amy J Sterling
(74) *Attorney, Agent, or Firm* — Thomas Raffin; Claude Anderson

(57) ABSTRACT

This invention is to an apparatus and method using a pivoting support structure to support mail boxes, newspaper tubes, information signage or decorative materials near a road while being less susceptible to damage from passing vehicles. The invention may be attached to a post, pipe or other vertical structure. Even after the apparatus is installed, the invention has an inherent flexibility to change the original starting position of the mail box relative to the road. Furthermore, the invention acts as a self-centering hinge allowing the support structure to swing in excess of 90-degrees to 180-degrees depending upon installation even while supporting single or multiple mailboxes and/or decorative or aesthetic items. The invention then automatically returns the mail box to its original starting position through the cooperative effort of a spring, gravity and inherent hinge design. This invention allows the structure to be temporarily cantilevered away from the vertical structure to assist in item placement or removal and allows the items such as mail to be removed without standing in traffic.

10 Claims, 7 Drawing Sheets

PIVOTING SUPPORT STRUCTURE

BACKGROUND OF THE INVENTION

The invention relates to a support system for holding a variety of planters, birdfeeders, statuary and sundry art while mounted onto a post or other vertical structure. This structure can be rotated up to 180 degrees to allow the object being supported to be rotated in such a manner as to allow the object to be removed from the support system without leaning out and lifting the object. This object could be heavy or the leaning may result in an awkward maneuver. This invention also relates to rural mailboxes, particularly support apparatus that make the mailbox installation resistant from damage by being struck by a snowplow, car or truck.

Roadside mailboxes, typically required to be installed in rural and suburban neighborhoods, have long been a source of constant maintenance and repair. If proper upkeep is not provided, the result is often unusable and/or unsightly installations.

U.S. Post Office specifications require that the mailbox extend to near the curb or road shoulder, so that the mail carrier can deliver the mail without leaving his/her vehicle. To remove the mail, the homeowner must stand in the in front of said mailbox, putting the person close to or in the actual path of traffic. The first sign or sound of approaching traffic usually results in the prudent person moving toward the curb.

The greatest potential for damage to a mailbox comes from a snowplow moving down the street at a moderate to high rate of speed. Attempting to do the best job possible of clearing the street, the plow driver tries to get as close to the edge of the road without hitting any mailboxes. Even though the snowplow operator very seldom actually hits the mailbox, the snow trailing off the plow blade is known to impact the mailbox and support system and can completely destroy even the sturdiest mailbox posts.

Roadside mailbox supports come in a wide variety of designs. These range from the basic 4-inch square post support to extravagant designs.

Varied attempts have been made to improve crash protection for mailbox supports. U.S. Pat. No. 7,249,704 issued July 2007 to Smith titled "Mailbox Multi-Position Support System" discloses a mailbox mounted on a lazy Susan type rotatable system mounted onto the center of a single post. This means the mailbox post needs to be positioned very close to the edge of the road and does not provide any real protection from being struck by a snow plow or other vehicle. In essence, this design only allows the owner to rotate the mailbox away from the road 90 to 180-degrees in either direction to remove mail without stepping onto the roadway.

U.S. Pat. No. 7,195,146 issued March 2007 to Dunn, et al titled "Deflector Mailbox Support System" discloses a mailbox mounted on a complicated rotation system on a post or an arm allowing the mailbox to rotate around its center point. When mounted on a post, this means that the mailbox post is located close to the road right-of-way. Even if the rotating apparatus was mounted on an arm away from the post, the arm is not movable and when the mailbox is struck, the mailbox and the arm or post the system is mounted on will be damaged and the mailbox will be laying on the ground.

U.S. Pat. No. 6,047,933 issued April 2000 to Hoover titled "Swing Arm Support for Mailbox" discloses a simple rotational assembly allowing for a mailbox to rotate 360-degrees around the center point of the post it is mounted on. Although simple in design, there is nothing in the design to ensure the mailbox remains orientated at 90-degrees to the road right-of-way. The simplicity of the design restricts the diameter of the post this system must be mounted on. Nor can this system to be easily moved higher or lower in order to meet Postal height requirements without raising or lowering the actual post it is mounted on. Finally, this design does not lend itself to any artistic embellishments other than changing the painting scheme used on it.

U.S. Pat. No. 5,779,202, issued July 1998 to Black et al, titled Pivoting Mailbox Post discloses a more simple rotational system than U.S. Pat. No. 6,047,933 but works on the same principle. There is nothing noted in this patent which ensures the mailbox remains perpendicular to the roadway in the event of high winds except perhaps the angle that the actual support post is placed in the ground nor is there any provisions for raising or lowering the mailbox as needed to meet postal height requirements without raising or lowering the actual post it is mounted on. Finally, this design does not lend itself to any artistic embellishments other than changing the painting scheme used on it and will only function if it is mounted on a post of a diameter large enough to properly retain the rod which holds the three main pieces in place.

U.S. Pat. No. 5,622,343 issued July 1995 to Morton titled "Mailbox Mounting Device" and discloses a Lazy Susan type system which is purported to allow the mailbox to return to it's original orientation if struck buy a vehicle. However, this design is much like U.S. Pat. No. 7,195,145 requires the rotational system to be mounted in the center of the mailbox. This does not provide the mailbox or post any protection if struck to the right of the mailbox center. This means the mailbox, post or arm the mailbox is mounted on will be damaged the same amount as if the rotational device was not used.

U.S. Pat. No. 5,437,409 issued August 1995 to Coushaine titled "Pivoting Mailbox Apparatus" discloses a simple mailbox support system capable of supporting only one mailbox. This is due to the need for two thin slotted brackets which appear to be easily broken since the natural tendency would be for the mailbox to rotate around the top of the arm when struck. Although this system allows for 90-degree rotation from the mounting point, it also requires a stop to be an integral part of the design in order to prevent the mailbox from being mounted too close to the post. This means the post size this support system us mounted on is limited to the stand off distance between the integral stop and post mounting surface. If a post wider than twice this stand off thickness is used, then the mailbox will impact the post before completing the 90-degree rotation. In addition, since any traffic that might hit the mailbox mounted on this design will approach it only from one direction and the 90-degree rotation away from on-coming traffic will not provide as much protection as 180-degree rotation from the normal position.

Moreover, the Coushaine design utilizes a single hook that is cast into the support arm on which newspapers, packages and other advertisements may be suspended using string or rubber bands. This hook system will not find favor with the personnel delivering advertisements since they cannot slide the advertisement into a tube and will probably have to exit their vehicle in order to attach their advertisement to the hook. Since advertisers will not use this hook feature, it means a separate tube on a separate post close to this support arm in which to place their products. If this secondary system is positioned too close, it will distract from any cosmetic value it might have. And finally, there is no way for the owner to customize this design other than to change its color scheme.

U.S. Pat. No. 5,400,958 issued March 1995 to Walker titled "Mailboxes Rotatable to any one of a plurality of Orientations" is much like U.S. Pat. No. 7,249,704, U.S. Pat. No. 5,622,343, and U.S. Pat. No. 7,195,146. Like the others, this design allows the mailbox to be rotated and allow the mailbox owner to get their mail without standing in the right-of-way but does little to prevent the mailbox, post or arm from being damaged if struck since it has to be mounted on a rigid post or arm.

U.S. Pat. No. 4,130,239 issued December 1978 to Belsheim titled "Swing-Away Mailbox" is a simple design which uses an angled rod to keep the mailbox orientated at 90-degrees to the right away as well as allowing the post to be positioned well off the road. It does not appear from the description that this mailbox support system is wide enough to support more than one mailbox nor does it have any provisions for newspapers to be deposited without a secondary post and container. Since this design forces the mailbox to rotate up when moved, this design cannot be used for any other purpose since anything placed on top of the arm it will fall off. In addition, this design must be mounted to the top of a post and cannot be mounted on the side of a post.

SUMMARY OF THE INVENTION

The invention is a pivoting support structure for supporting various objects when attached to a vertical structure. The pivoting support structure has a support arm for mounting one or more mailboxes at a conveniently visible and/or accessible position near a roadway as well as mounting planters, bird feeders as well as statuary to decks and posts around an individual's property. The pivoting support structure also may have the following parts; a mounting arm, a support tube consisting of an upper and lower angled support tube, a shaft, and a spring.

The pivoting support structure may be fabricated from metals such as aluminum or steel; polymers such as fiberglass or plastics; or combinations of metal, wood and/or polymer.

The support tube includes two independent pivoting features as described in this invention.

The first pivoting feature, a lateral force rotational function, allows rotation about a shaft to automatically respond to a lateral force against the mail box or pivoting support structure. The pivoting function helps minimize damage or destruction of the mailbox installation by allowing the mailbox to move out of the way. The pivoting support structure translates the lateral force into a rotational movement so that a lower angled support tube rotates at its interface with an upper angled support tube. The rotational movement biases a spring into further compression. The increased compression of the biased spring against the support tube in cooperation with the weight of the rotated assembly is used to automatically assist restoring the mailbox to its starting position. This function can also be is used to move the mailbox out of the traffic pattern for various reasons, such as safely removing the mail.

The second pivoting feature, a multi-positional rotational function, allows the angle of rotation about the shaft to be manually changed by the user in order to change the starting position of the pivoting support structure to any of several desired starting positions. This function allows the position of the pivoting support structure to be changed relative to the supporting post and allow the support arm to rotate either clockwise or counterclockwise from the starting position.

The multi-positional rotational function is preferably completed by manually compressing the spring to physically release a locking mechanism within the upper angled support tube. The pivoting support structure is then free to rotate about the shaft and the pivoting support structure may be rotated to the desired starting position. The spring is then released and the locking mechanism holds the pivoting support structure in its new starting position.

It is an object of the invention to provide a pivoting support structure that can be installed so the pivoting support structure height is independent of the post installed depth.

It is an object of the invention to provide a pivoting support structure that is durable with its performance relatively independent of water, salt and sand.

Another object of the invention is to provide a pivoting support structure that is economical to manufacture.

It is still another object of the invention to provide a pivoting support structure that can be customized by the user in a number of attractive designs.

Another object of the invention is to provide a pivoting support structure that allows the homeowner to use to support a mailbox and to retrieve the contents of the mailbox without entering the street.

Another object of the invention is to provide a pivoting support structure that pivots when struck from the side and then returns to its original position.

It is an object of the invention to provide a pivoting mailbox assembly that does not require maintenance of the pivoting mechanism from the effects of salt, sand and water.

Another object of the invention is to provide a pivoting support structure assembly that maintains a substantially horizontal position, during the entire rotation travel.

It is a final object of the invention to provide a support structure that is functionally capable of complying with all United States Post Office regulations and guidelines.

DETAILED DESCRIPTION OF THE INVENTION

This invention discloses a pivoting support structure for holding items such as vehicle accessible rural mailboxes as well as planters, birdfeeders, statuary or other ornamental decorations that are typically fastened to a post, pipe, fence, wall or other vertical structure.

Pivoting Support Structure 10

Figure 1:
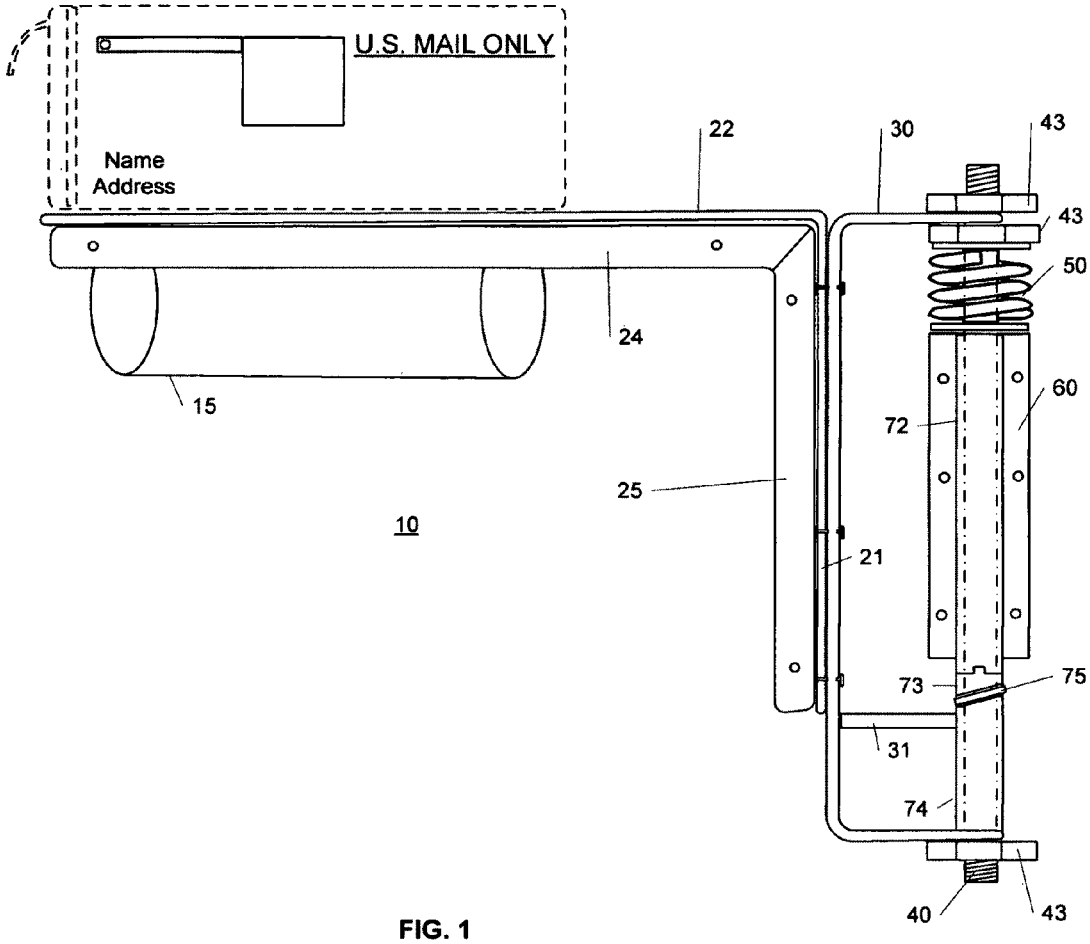
FIG. 1 is a side elevation view of an embodiment of the pivoting support structure.
Figure 2:
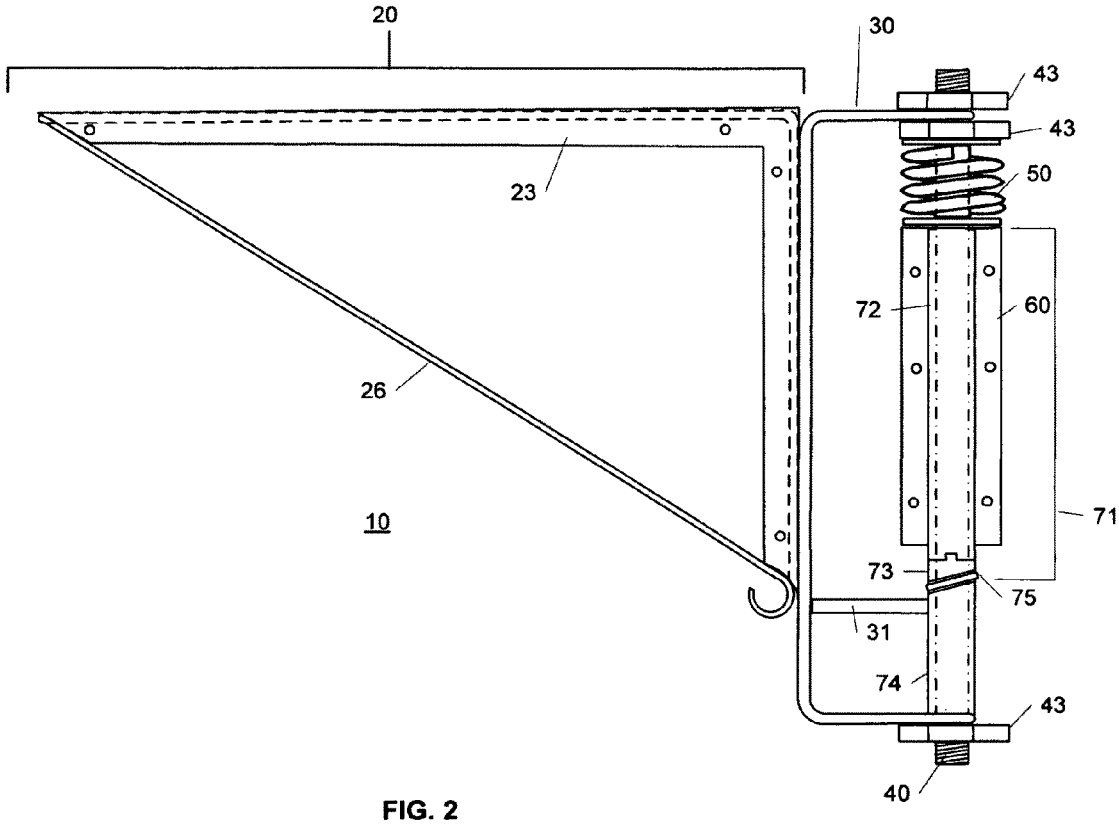
FIG. 2 is a side elevation view showing another embodiment of the support arm.
Figure 3:
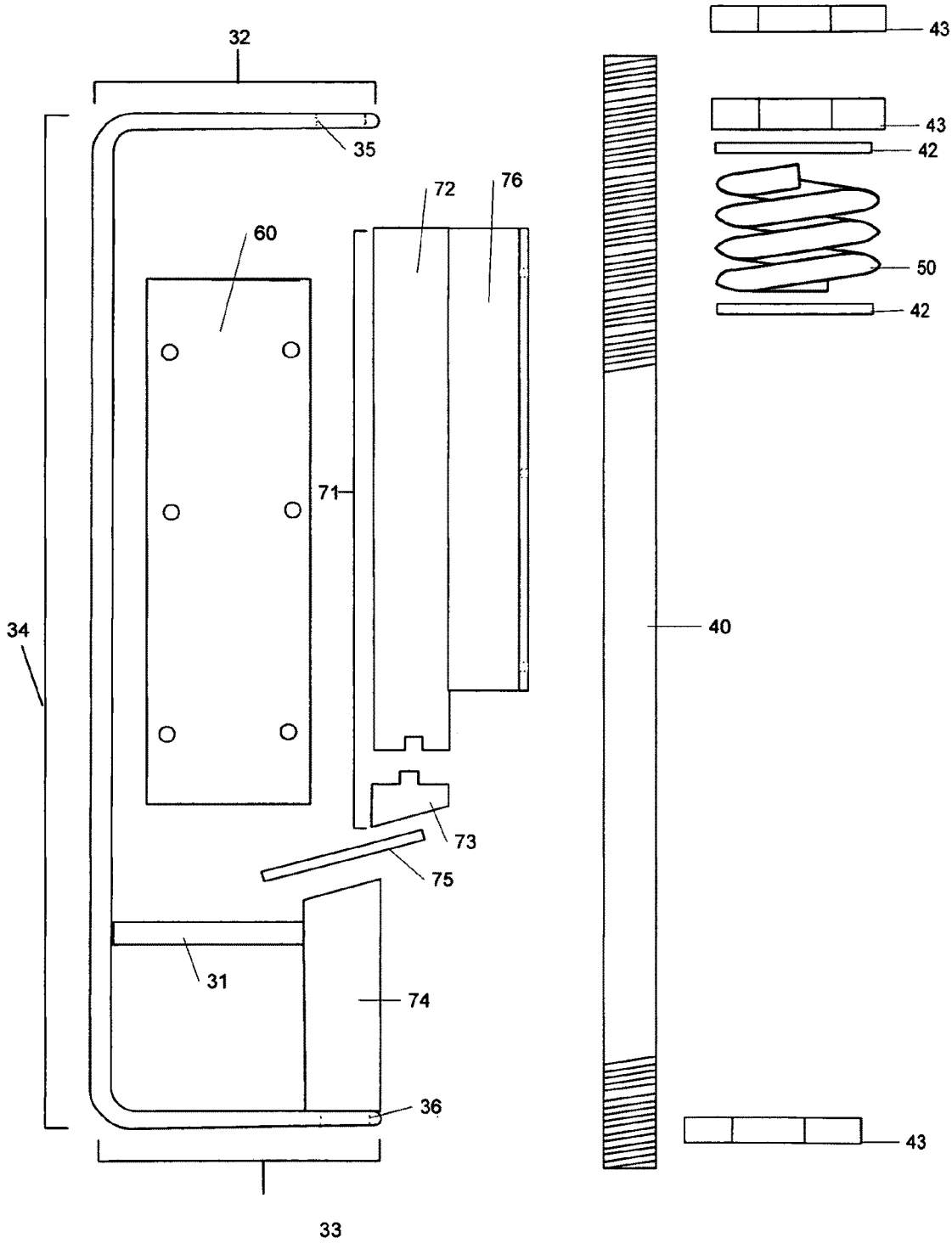
FIG. 3 is an exploded view of several details of the pivoting support structure.

FIGS. 1 and 2 show side elevation views of embodiments of the pivoting support structure 10. The invention provides a means for attaching various objects to a vertical surface. A pivoting support structure 10 having a support arm 20 for attaching a newspaper tube 15, planters, mailboxes or other items to a vertical structure 90 (See FIG. 4) such as a post is disclosed. As shown in FIG. 2, the pivoting support structure 10 includes a support arm 20, a mounting arm 30, a support tube consisting of an upper angled support tube 71 (FIG. 3)

and a lower angled support tube 74, a shaft 40, spring 50 and several braces for additional strength as described in further detail herein.

The support arm 20 is permanently attached or manufactured integrally to the mounting arm 30. The mounting arm 30 is attached to a support tube that may be directly or indirectly securely attached to a post or deck railing while the mounting arm 30 remains rotatable about a shaft 40. The shaft 40 may freely rotate within the support tube having portions defining an upper angled support tube 71 and a lower angled support tube 74. The upper angled support tube has a fixed portion 72 and a positioning portion 73. The upper angled support tube 71 is directly or indirectly attached to plate 60 via support tube standoff 76 and the vertical structure 90 at the fixed portion 72. The positioning portion 73 is rotatable to allow positioning of the pivoting support structure. The lower angled support tube 74 is fixedly attached to the mounting arm 30, rotatable about the shaft 40 upon the impact of lateral forces as described. A spring 50 keeps tension on the support tube components cooperating with gravity to keep the rotating assembly with the pivoting support structure in proper position.

Support Arm 20

The support arm 20 is preferably constructed of 18 gauge or thicker steel preferably bent or formed into a vertical leg 21 and a horizontal leg 22 to form an orthogonal angle of approximately 90-degrees between the two legs of the angle. Preferably the horizontal leg 22 is at least 2 times longer than the vertical leg 21. The support arm's vertical leg 21 is attached directly or indirectly to the mounting arm 30 through welding, mechanical fasteners or other means so that the mounting arm 30 and the support arm 20 rotate as a unit.

As shown in FIG. 1 the support arm 20 may have two parallel support arm horizontal braces 24 positioned along the outside edges of the horizontal leg 22 of the support arm 20 and/or two parallel support arm vertical braces 25 positioned along the outside edges of the vertical leg 21. These vertical and horizontal braces may have provisions for mounting decorative art panels to either side.

As shown in FIG. 2 an angular brace 26 may connect the horizontal leg 22 with the vertical leg 21 to form an opening between the support arm 20 and the angular brace 26. A portion of the support arm 20 may have a support arm flange 23 to which various items may be attached across the opening. The support arm flange 23 as well as the attached items may provide further structural strength to the support arm 20. The various portions of the support arm 20 is preferably manufactured by bending a single metal sheet into the various portions.

The support arm flange 23 may be fabricated by folding down a ⅜ inch to ½ inch area along the longest horizontal and vertical structure 90 of the support arm 20 to provide strength and a mounting surface for interchangeable decorative artwork or signage panels though the use of weld-nuts or other fasteners which may conceal a newspaper tube 15 for the delivery of newspapers and other advertisement not allowed to be inserted into a mailbox when the support arm 20 is used for that purpose.

The width of the support arm 20 is between 4 and 8 inches depending on the size and application of objects to be mounted on top. Items to be mounted on this surface may include statuary, flower boxes, bird feeders or baskets, and even multiple mailboxes mounted per the mailbox manufacture's recommendations. The width of the support arm 20 is such to allow a newspaper tube 15 of at least 3 inches in diameter to be mounted underneath between the two braces to receive items such as newspapers and other advertisements which cannot be legally placed inside the mailbox by others. If the lower section of the tube is partially sealed on both ends, it can be used to suspend ivy plants or other such vegetation under the support arm 20 when the support arm 20 is used for plants or statuary.

If needed, a support surface can be extended in width using items such as a board or other wider platforms mounted on this support arm 20 in order to place larger objects such as up to three mailboxes on top of the support arm as long as the total weight of the objects mounted on top of this support arm 20 is centered on the support arm and the total weight does not exceed the device's design criteria of, for example, 100 pounds.

Preferably, two arm angular braces 26 are mounted under the support arm 20 at between a 30 to 50-degree angle depending upon the horizontal to vertical length ratio of the support arm 20. Doing so, forms a triangular structure having additional strength with an opening between the sides of the formed triangle. If needed, additional support arm horizontal braces 24 and support arm vertical braces 25 may also be used along the legs of the support arm 20. All braces may be securely attached using bolts, rivets, or welding.

The width and thickness of the support arm 20 is proportional to the horizontal length of the support arm 20 and the amount of weight to be supported by the device.

The lower portion of the support arm 20 and/or angular braces 26 can be fashioned into a circular hook orientation with which hanging flower baskets or other decorations can be hung. This orientation ensures these hanging decorations do not protrude beyond the end of the support arm 20.

Mounting Arm 30

Attached to the support arm 20 is a mounting arm 30 having an upper horizontal portion 32, a lower horizontal portion 33 and a vertical portion 34 between the upper horizontal portion 32 and the lower horizontal portion 33 with support brace 31 and lower angle support tube 74 permanently affixed to mounting arm 30. The mounting arm 30 may preferably be constructed out of continuous 0.125-inch or thicker strap iron or equivalent that preferably is at least 1-inch in width. The mounting arm 30 is attached to the support arm 20 along the vertical portion 34. As shown in FIG. 3, the general shape of the mounting arm 30 is in the shape of a "C" also having at each end a top opening 35 concentrically orientated with a bottom opening 36 positioned to accept a shaft 40, with the mounting arm 30 being rotatable about the shaft 40 around opening 35 and 36. The openings are positioned in the mounting arm 30 to provide sufficient material to allow use through multiple iterations of rotations without wearing through.

The depth of the mounting arm 30 (horizontal portion lengths) is preferably at least 2-inches or more in order to position the support arm 20 beyond one-half the thickness of the post or of the vertical structure 90 the support arm 20 is mounted on. The depth of the mounting arm 30 needs to be long enough to ensure that the mounting arm 30 is affixed in the center of post it is mounted on the support arm 20 can rotate 180-degrees and the items mounted on the support arm 20 will not strike the post.

The mounting arm 30 will be firmly attached either mechanically using screws, bolts, rivets or welding to the center of the vertical leg 21 of the support arm 20 or other means.

Figure 4:
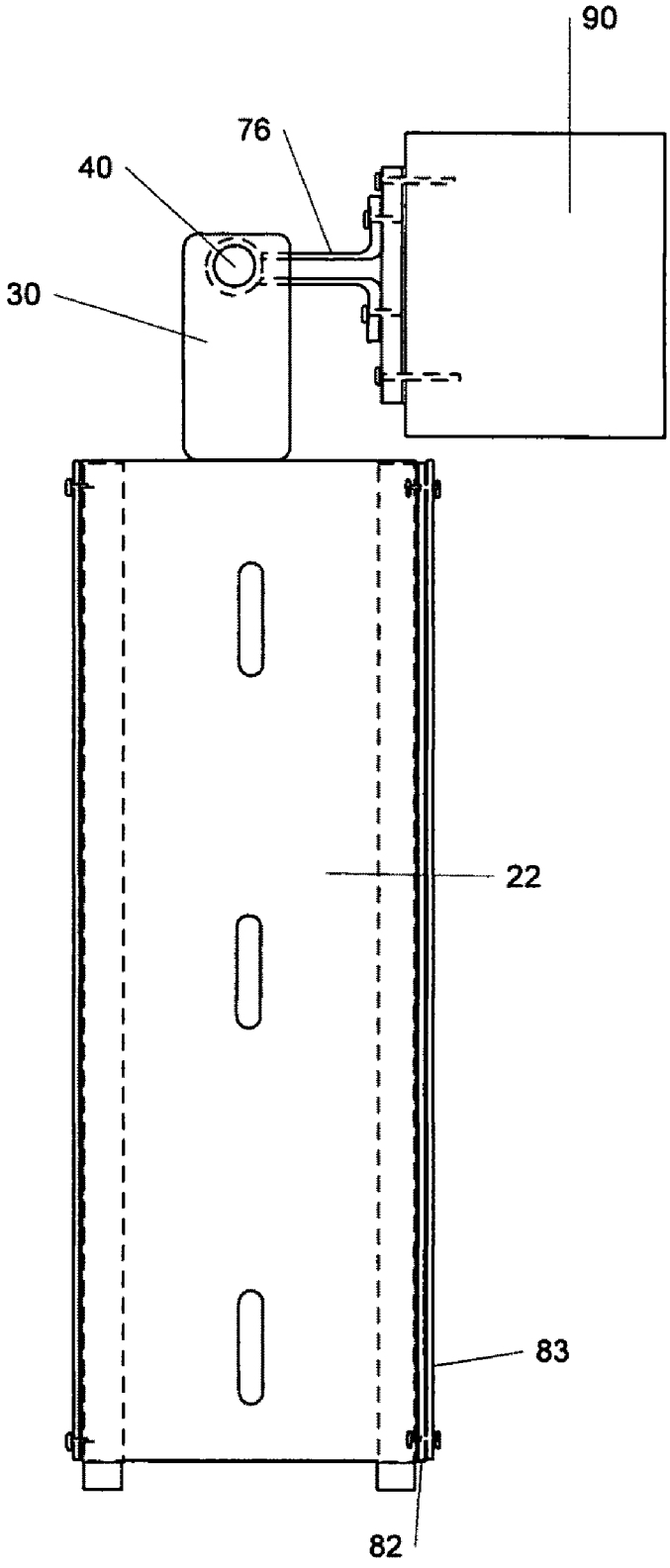
FIG. 4 is a top view of an embodiment of the pivoting support structure.

The ends of the mounting arm 30 are chamfered as needed to provide clearance for the mounting arm 30 and prevent it from binding on the post as shown in FIG. 4.

A mounting arm brace 31 may be provided between the mounting arm 30 and the lower angled support tube 74. This brace would provide strength and stability to the mounting arm 30 and may increase the rigidity of the overall support system.

One end of the mounting arm brace 31 may be cut to match the OD of the lower angled support tube 74. The other end may be cut perpendicular to the length.

The mounting arm brace 31 may be welded parallel to the bottom side of the support at a location just below the angle cut on the lower angled support tube 74.

Support Tube Assembly

Located between the ends of the mounting arm 30, the support tube assembly transfers the weight of the rotatable assembly including the mailbox or other items, support arm 20 and its contents to the vertical structure 90, while providing pivoting functions for repositioning the support arm while protecting the support arm 20 and vertical structure 90 from undesired lateral forces that might otherwise provide damage to the support arm. Some details of the support tube are provided in FIG. 3.

The support tube is preferably provided as an upper angled support tube 71 and a lower angled support tube 73 which may be conceptualized as an oblique cut that is not perpendicular across the support tube forming an acute angle and an obtuse angle which are supplementary angles on each portion. With the acute angle being between 5 and 55 degrees with the exact angle to be matched with the diameter of the tubing and length of support arm 20 in order to keep the support arm 20 in the non-rotated or starting orientation during weather conditions short of tropical storm strength winds.

The upper angled support tube 71 is further divided into a fixed portion 72 and a positioning portion 73, which in the preferred embodiment may be conceptualized as a cut along a perpendicular plane between the two portions with indexing teeth which may alternatively have a serrated configuration.

The support tube is rotatable about a shaft 40, the portions kept appropriately engaged due to the weight of the support arm 20 and a spring 50 used to provide tension to the support tube.

The upper end of the support tube is preferably parallel and no higher than the upper end of steel plate 60 via an appropriate sized spacer 76. The inside diameter (ID) shall be of sufficient size to allow the threaded shaft 40 to pass through it. The wall thickness shall be sized to provide sufficient strength and wall thickness to provide sufficient bearing surface area to allow for the support arm 20 to rotate smoothly without deformation.

Upper Angled Support Tube 71

The upper angled support tube 71 is attached to the vertical support structure through the fixed portion 72. As shown in FIG. 4, the fixed portion 72 may be welded or bolted "U" shaped bolts to the plate 60 or a support tube using a stand-off 76 providing clearance for the rotation of 20 with welding being the preferred method. The orientation of 73 provides the angle to the steel plate 60 such as to allow 180-degree rotation in a clockwise, counterclockwise direction. Alternatively, the orientation of the angle to the steel plate 60 may be such as to allow a 90-degree rotation in either direction for a total 180-degree rotation.

The positioning portion 73 of the upper angled support tube 71 is located between the fixed portion 72 and the lower angled support tube 74 along a generally perpendicular interface.

The positioning portion 73 interfaces with the fixed portion 72 and provides the multi-positional rotational function for the support structure. This pivoting function allows an adjustable starting or resting position to be selected so that the user may manually adjust the starting rotational position of the support arm desired. The mounting of the support arm to decks or other vertical surfaces and allow the support arm to be rotated as needed to tend planters or fill birdfeeders.

Benefits of this function include for example, temporarily swinging the support arm with a mailbox mounted on it out of the traffic right-of-way when removing the mail, or allowing an adjustment in the support arm rotational direction to provide flexibility in positioning the support arm mounted on a post or other vertical mounting surface.

Figure 5:
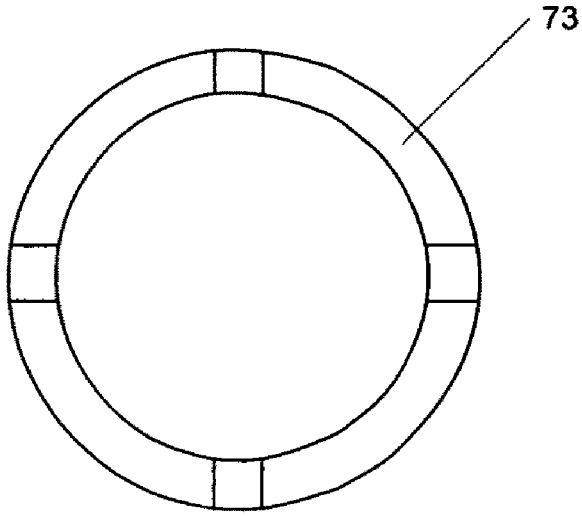
FIG. 5 is an top end view of details of the positioning portion of the upper angled support tube.

With this feature, the upper angle support tube is manufactured in two pieces with the over all length the same as the upper angled support tube 71 without the angle rotation feature. This angle rotation feature allows for the angled surface to be rotated in 90-degree increments. As shown in FIG. 5, this feature will change the angle of rotation to allow the support arm 20 to swing 180-degrees clockwise, 180-degrees counter clockwise or 90-degrees from the normal rest position that is perpendicular to the post it is mounted on.

This feature requires the cutting of a minimum of two notches in the upper angled support tube 72 in an area above the highest point of the angle cut. These notches are cut at 90-degrees to each other. This feature requires the cutting the mating surface of the positioning portion 73 in a way to produce a "tooth" that fits into the notch.

Figure 6:
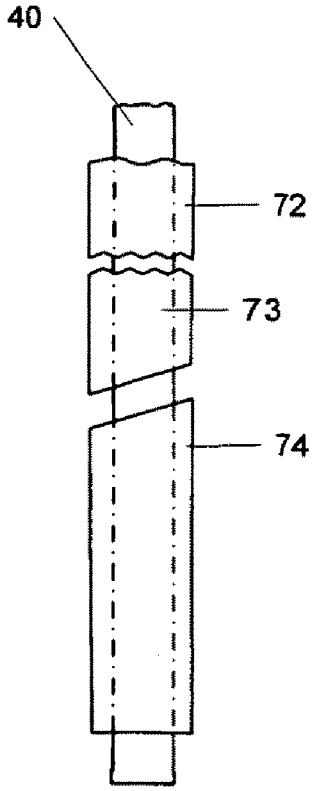
FIG. 6 is a side view of details of an additional embodiment of the support tube.
Figure 7A:
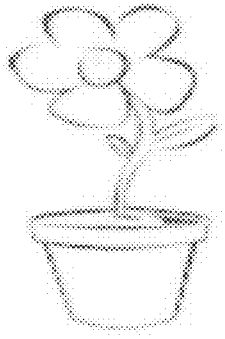
FIGS. 7A-7D are representations of possible ornamentation that may be placed on the pivoting support structure.
Figure 7B:
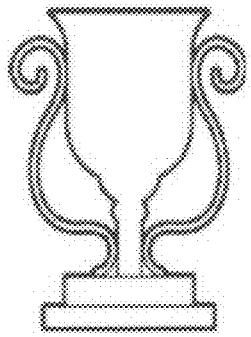
Figure 7C:
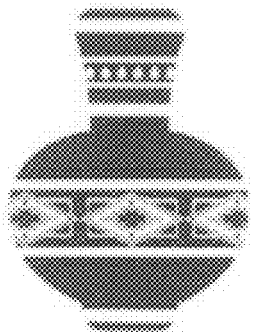
Figure 7D:
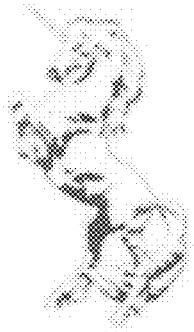

Alternatively, as shown in FIG. 6, a large number of positions can be provided by using relatively close spaced serrations in the mating surfaces of the fixed portion 72 and the positioning portion 73 of the upper angled support tube 71.

The multi-positional rotational function is preferably completed by manually decompressing the spring 50 to physically release a locking mechanism within the upper angled support tube 71. Using nut 43 on the top may decompress the spring 50. Piece 73 is then free to disengage from the locking system and rotate about the shaft 40 and the support arm can then be rotated to its new desired starting position. The spring 50 is then placed in compression using nut 43 as needed and the locking mechanism holds the support arm in its new starting position.

Lower Angled Support Tube 74

The lower angled support tube 74 is preferably about ½ to ¼ the length of the upper-support tube 71. The tube inner diameter, outer diameter and wall thickness shall preferably match that of the upper angled support tube 71.

The lower angled support tube 74 is rigidly attached to the mounting arm 30. The attachment is at the lower horizontal portion 33 and the mounting arm brace 31.

The interface angle is preferably not perpendicular to the support tube longitudinal axis. The interface angle of the lower angled support tube 74 is preferably supplementary with the interface angle of the upper angled support tube 71. As such, the acute angles of the lower angled support tube 74 shall be orientated 180-degrees from the angle of the upper angled support tube 71.

The lower angled support tube 74 ID shall be centered on the bottom opening 36 in lower horizontal portion 33 of the mounting arm 30 and perpendicular to the inside surface of the mounting arm 30 and welded 360-degrees around the mating surfaces. After welding, there shall be sufficient clearance through the mounting arm 30 and lower angled support tube 74 to allow the threaded shaft 40 to pass through it.

A thrust washer 75 of sufficient thickness may be used to provide a malleable surface on which the upper and lower angled tubes can rotate. The thrust washer 75 may be made of brass, steel, Teflon, nylon or plastic as needed for the application.

The shaft 40 also having a plurality of washers 42 and nuts 43 for tensioning; a compression spring 50 surrounding the shaft 40 and between the top portion of the upper angled support tube 71 and the top horizontal portion of the mounting arm 30, wherein the rotation of the mounting arm 30 and the support arm 20 causes the spring 50 to be compressed as lower angled support tube 74 rotates which changes the angle on the top of lower angled support tube 74 in relation to the angle on the bottom of upper angled support tube 71; wherein a lateral force against the two angled surfaces encourages the return of the support arm 20 to the pre-impact starting orientation.

The lateral force pivoting function allows the support arm 20 to rotate rather than bend or break in response to a lateral force from a vehicle striking the mailbox or a snowplow pushing snow into the mailbox.

The spring 50 and the inherent structural weight resist the rotation of the lower angled support tube 74, since the pivoting must lift the mailbox and compress the spring 50 due to the angled nature of the interface between the upper and lower support tube. This response produces a gap between the upper and lower support tube thereby lengthening the overall height of the support tube through the compression of spring 50. This occurs automatically upon the imposition of sufficient lateral force. Once the force is dissipated or removed, the weight of the structure and the compression of the spring 50 will tend to automatically restore the support arm to its starting position via the rotation between the upper and lower support tubes as the gap closes.

Shaft 40

The shaft 40 having a top end and a bottom end also having threads to accept fasteners with washers 42 with a spring 50 surrounding at least a portion of the shaft 40 between the upper horizontal portion 32 and the lower horizontal portion 33 of the mounting arm 30. The shaft 40 also being positioned throughout a support tube having an upper angled support tube 71 and a lower angled support tube 74, the shaft 40 being rotatable within at least portions of the support tube and a lower angled support tube 74. The shaft 40 extends through the upper and lower angled support tube 74, the ends of the mounting arm 30 and the spring 50. The shaft 40 is preferably threaded at both ends to secure the support tube. Nuts 43 and washers 42 may be used to secure the bolt as well as provide compressive force on the spring 50. This provides the force needed to keep the support arm 20 locked into position by means of the corresponding faces of the support tube and a lower angled support tube 74 in place. The threaded section on the upper end must be long enough to allow for the compression nut 43 to thread down and compress the spring 50 preferably to at least 50% of its length as well as allow a nut to be threaded on the upper section Preferably at least two nuts 43 are used along the shaft 40. In addition to the nuts 43 on the outside of the mounting bracket to retain the threaded rod in place, a compression nut 43 may be used on the inside of the mounting brace to compress the spring 50 to apply pressure to the angled tube components to ensure that strong winds cannot rotate the support arm 20 out of position if something with a large surface area is placed on the horizontal surface of the mounting arm 22.

The compression nut 43 is adjusted by the user as needed to keep the support arm 20 in the proper orientation and still allow the support arm 20 to rotate the 90 or 180-degrees as desired.

Spring 50

A spring 50 to provide tension to on the two angled tubes sufficient to hold the loaded support arm 20 in position when subjected to minor lateral forces such as wind impact, but sufficiently compliant to be releasable manually for repositioning and to bias automatically when force is applied to the side of the loaded support arm 20.

Washers 42 are preferably on either end of the spring 50 to ensure a load bearing surface against the spring 50 that allows the mounting arm 30 to rotate. The overall outside diameter and thickness of spring 50 is sized to ensure sufficient compression and still allow the overall reduction in length which will occur as the support arm 20 rotates 180-degrees and the angle surfaces cam action separate the two angle surfaces.

The minimum diameter of the spring 50 is large enough to allow the threaded rod to be inserted through it and the wire thickness diameter will be sized to provide sufficient tension against an upper angled support tube 71 to keep the support arm 20 in position during normal atmospheric conditions but will still allow the support arm 20 to rotate up to 180-degrees in a clockwise or counterclockwise direction should it be struck with enough force to over come the resting inertia of the support arm 20 and the items placed on or hung from it. The tension on the spring 50 is further adjustable by adjusting the tension on the spring 50 with a top nut 43.

The apparatus may be furnished with a spring 50 compressor to permit easy placement when manual rotation of the support arm 20 is desired.

Plate 60

The plate 60 allows flexible height placement of the mailbox independently of the post height as long as the minimum post height is greater than the lowest required installation height, since conventional fasteners such as nails, bolts or lag screws may be used. This allows the post to be installed at any height desired based on site conditions. The plate 60 may then be attached at the required height after the post is installed. A plate 60 typically constructed of steel of sufficient thickness, length, and height is preferably used to secure the support arm 20 to a post, pipe, wall or other vertical structure 90 using screws, bolts or U-shaped bolts as desired.

A minimum of four and up to eight or more holes are typically required to be drilled around the outer edges of support plate 60 for the owner to use to mount the support arm 20 to a post or wall.

Generally, the steel plate 60 length will be sufficient to equal the length of the fixed portion 72 of the upper angled support tube 71.

The plate 60 is connected directly to the upper angled support tube 71 or through the upper angled support tube standoff 76. When needed, the upper angled support tube stand-off 76 serves as a spacer to ensure sufficient rotational clearance between the mounting bracket 30 and the post depending on the width of the mounting bracket. The thickness of the standoff is in direct proportion to the width of the mounting arm 30 material.

Optional Features

Figure 8:
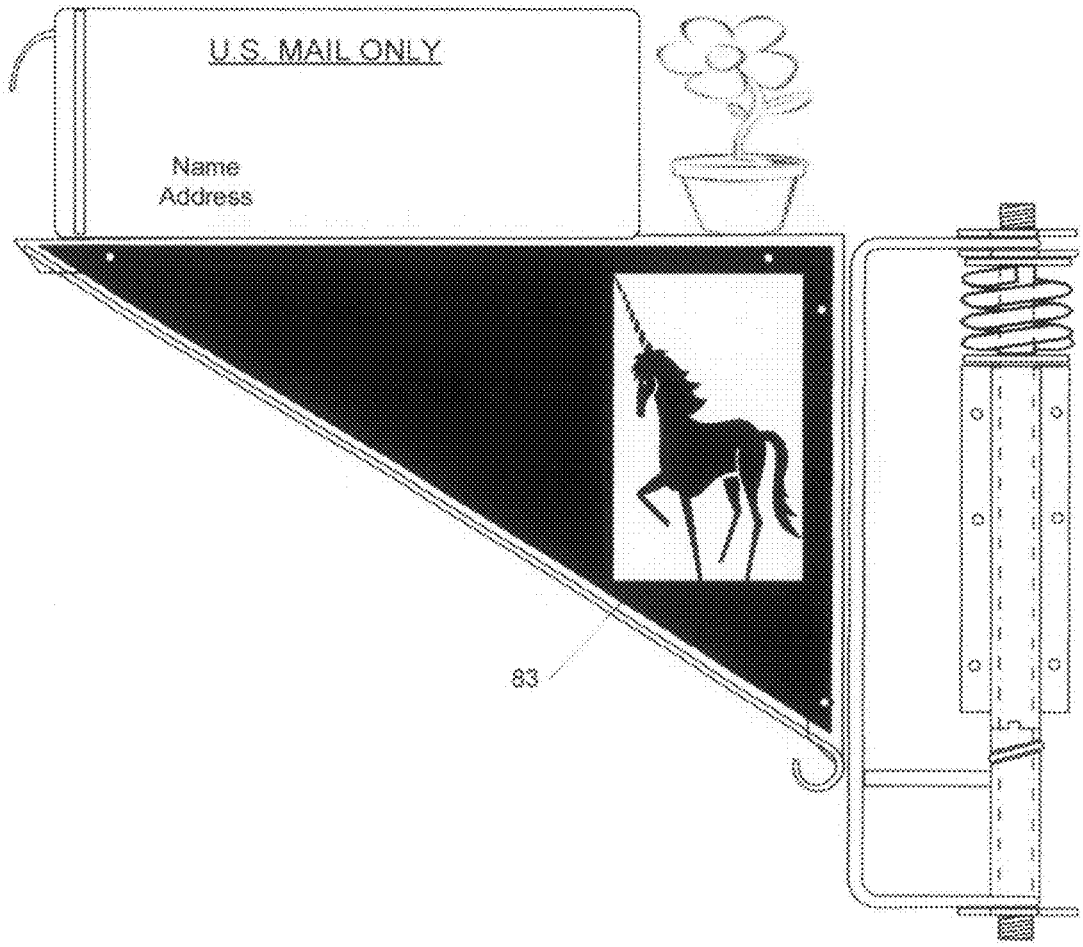
FIG. 8 is a side elevation of an embodiment of the pivoting support structure with ornamental features.

As shown in FIGS. 7 and 8, optional features may be included on various embodiments of the invention. An optional planter may be offered which can be mounted under the support arm 20 between the horizontal braces to allow the growing of vine type plants. These plants can be allowed to grow up and around statuary placed on top of the support arm 20 or allowed to hang down as the owner wishes. In addition, if the support arm 20 is used to support a mailbox, an optional tube will be offered which can be mounted between the horizontal braces. This optional newspaper tube 15 provides a place for newspapers or other non-postal deliveries eliminates the need for a separate holder to be attached to the side of the support arm 20 or mounted on a separate post next to the mailbox which could be cosmetically displeasing in appearance to the property owner.

The use of decorative panels will provide the owner a way to personalize their support arm and for seasonal themes or other symbolic artwork and add to the overall strength of the support arm 20. Weld nuts, clips 43, or other fastening systems will be mounted onto the support arm 20 to allow easy attachment or removal of decorative panels 83 onto the side of the support arm 20 as the owner desires.

The general shape of these decorative panels 83 should be rectangular to match the length and height of the support arm 20 with a minimum of three holes drilled in them corresponding to the location of the weld-nuts in the support arm 20. Panels of other sizes and shapes may be mounted using the same support arm weld-nuts but will not be recommended since larger rectangular or square panels will increase the surface area exposed to the wind and increase the chances that a strong wind guest may cause the support arm 20 to rotate away from it's normal resting position. The size and shape of the decorative artwork panels shall comply with all Postal regulations if the support arm is used to support mailboxes.

These decorative panels 83 can be made out of wood, plastic, stained glass or metal with metal being the preferred material since metal will provide additional strength and rigidity to the support arm 20 for heavier loads placed upon it and can survive multiple lateral impacts.

The artwork on these panels can be cut in using silhouette format, painted, applied using stencil type appliqué, or even stained glass.

If silhouette or stained glass artwork is used, then the use of an opaque backing 82 will be recommended to defuse the lighting source and soften the lighting effect to better illuminate the artwork.

Decorative angle artwork fastening screws. Screws with threads matching that is used in the weld-nuts in will be used to secure the decorative artwork onto the support arm 20 to allow for easy interchange of decorative panels 83.

An option night lighting system such as low wattage lighting or solar charged battery operated lighting can be installed to back-light the decorative panels 83 if the decorative artwork uses a cut-out style producing something in silhouette fashion, or stained glass is used. Similar effects can be had using light color translucent panes and stenciled artwork. Plastic and stained glass will not provide the intrinsic support and additional strength that a painted metal artwork would have which would be needed if very heavy loads such as large planters were placed on the arm. Any lighting must comply with all postal regulations when the support arm is used to support a mailbox.

While there have been described herein what are at present considered to be the preferred embodiments of this invention along with several alternative embodiments, it will be obvious to those skilled in the art that changes to this basic structure can be made and this present invention is based to cover all such modifications.

What is claimed is:

1. A pivoting support structure for supporting items to be fastened to a vertical structure comprising:

a support arm having a vertical leg and a horizontal leg connected at an orthogonal angle;

at least a portion of the horizontal leg supporting at least one item;

a mounting arm having a upper horizontal portion, a lower horizontal portion and a vertical portion between the upper horizontal portion and the lower horizontal portion;

the mounting arm fixedly attached to the support arm along the vertical portion;

the mounting arm also having a top opening and a bottom opening positioned to accept a shaft;

a spring surrounding at least a portion of the shaft between the upper horizontal portion and the lower horizontal portion of the mounting arm;

the shaft positioned throughout a support tube having an upper angled support tube and a lower angled support tube, the shaft being rotatable within at least portions of the support tube;

the upper angled support tube having a fixed portion and a positioning portion;

the fixed portion being rigidly restrained from rotation;

the positioning portion being rotatably repositionable with respect to the fixed portion to reposition the support arm; and the mounting arm lower horizontal portion being fixedly attached to the lower angled support tube so that lateral forces transmitted to the mounting arm will rotate the lower horizontal portion and additionally bias the spring.

2. The pivoting support structure of claim 1 wherein the support arm can rotate at least 180-degrees in one direction without interference from hitting the vertical structure.

3. The pivoting support structure of claim 1 further comprising an angular brace connecting the horizontal leg with the vertical leg to form an opening between the support arm and the angular brace.

4. The pivoting support structure of claim 1 further comprising a support tube standoff located between the vertical structure and the upper angled support tube.

5. The pivoting support structure of claim 1 further comprising a thrust washer interposed between the upper angled support tube and the lower angled support tube.

6. The pivoting support structure of claim 1 further comprising a decorative area that can be used to provide a variety of designs.

7. The pivoting support structure of claim 1 wherein the spring tension can be adjusted using a plurality of washers and nuts for tensioning.

8. The pivoting support structure of claim 1 having the support arm holding a mailbox.

9. The pivoting support structure of claim 1 wherein the vertical structure is a post.

10. The pivoting support structure of claim 1 further comprising a night lighting system.

* * * * *